United States Patent [19]

Hayes

[11] Patent Number: 5,012,923

[45] Date of Patent: May 7, 1991

[54] SUBDIVIDED FLARE-HOLDING CONTAINER

[76] Inventor: Robert Hayes, 19A Forrest Glen Rd., Valley Cottage, N.Y. 10989

[21] Appl. No.: 495,719

[22] Filed: Mar. 19, 1990

[51] Int. Cl.[5] ..... B65D 85/20; B65D 25/04; B65D 25/10

[52] U.S. Cl. ..... 206/443; 206/573; 206/803; 206/523; 217/25.5

[58] Field of Search ..... 206/443, 573, 523, 592, 206/803; 217/25.5, 6, 21, 26.5, 27

[56] References Cited

U.S. PATENT DOCUMENTS

| | | | |
|---|---|---|---|
| 2,220,407 | 11/1940 | Joss | 206/803 X |
| 2,392,675 | 1/1946 | Lamb | 217/21 X |
| 2,672,980 | 3/1954 | Halbach | 217/27 X |
| 3,254,756 | 6/1966 | Rankin | 206/573 X |
| 3,955,704 | 5/1976 | Smith et al. | 217/25.5 |
| 4,434,890 | 3/1984 | Sieck et al. | 206/443 |
| 4,932,533 | 6/1990 | Collier | 206/443 X |

FOREIGN PATENT DOCUMENTS

| | | | |
|---|---|---|---|
| 1553868 | 10/1979 | United Kingdom | 206/443 |

*Primary Examiner*—William I. Price

*Attorney, Agent, or Firm*—Philip Furgang

[57] ABSTRACT

A subdividing structure is fitted and secured within and disposed at the bottom of a carton, box, package of similar container structure to receive and position within the container road flares for transportation storage and use. The subdividing structure is constructed either from interfitting members which together form an "egg crate" like set of compartments, one for each flare or from high density foam formed with a plurality of spaced compartments. The subdividing structure compartments are each of a size and configuration to hold a single flare and of a height such that the ends of the wire support for the respective flares are disposed above the top of the subdividing structure so that the wire ends do not trap the flares in their respective compartments or otherwise hinder removal of the flares from their respective compartments. The container is formed in box-like configuration from cardboard, boxboard, plastic or the like and of a size and configuration to receive the subdividing structure and road flares when disposed therewithin. The upper lip of the container is at a height so that when the container is open the tops of the road flares are readily accessible.

15 Claims, 1 Drawing Sheet

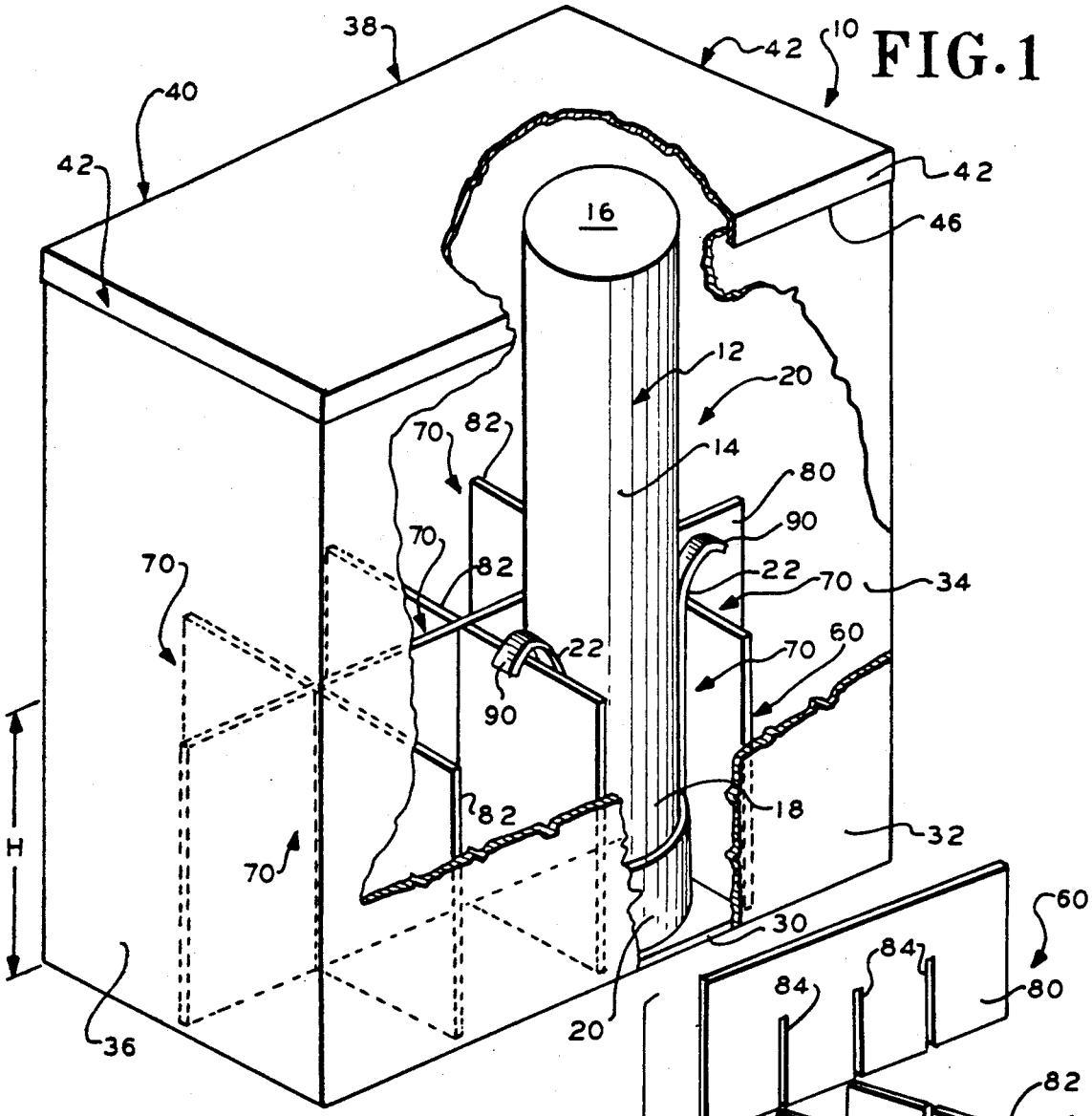
FIG. 1
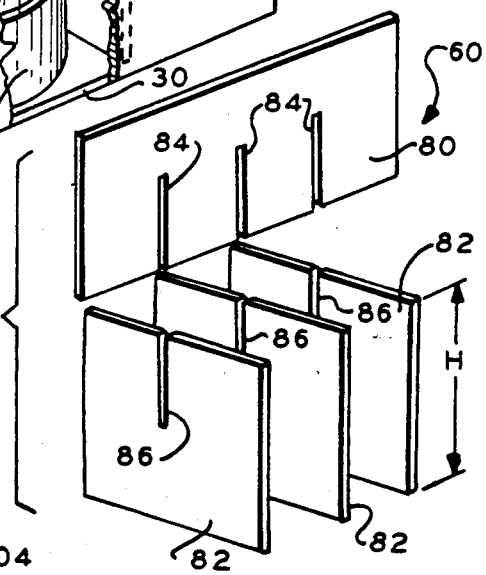
FIG. 2
FIG. 3
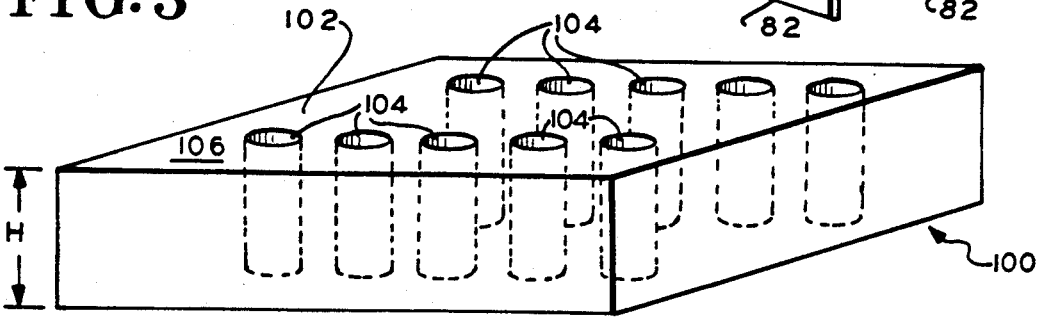

SUBDIVIDED FLARE-HOLDING CONTAINER

BACKGROUND OF THE INVENTION

Field of Application

This invention relates to carbons, packages, boxes and like containers; and, more particularly, to such cartons, packages, boxes and like containers that are internally subdivided to accommodate disposition with the carbon, package, box and similar container of articles of a particular configuration, purpose or need.

BACKGROUND OF THE INVENTION

Description of the Prior Art

Many articles, whatever there configuration, purpose or need are disposed in a carton, box, package or similar container to facilitate transportation and storage of the article, to protect the article from the elements and from being damaged during its transportation and storage and until used; and in some instances to facilitate use of the article. Quite often a number of articles are to be transported, stored or used together and containerization such as shown in U.S. Pat. No. 4,815,625 issued on Mar. 28, 1989 to S. J. Filhol, et al. for *Packing System* may be utilized. However, such individual containerization of each article may not be economically warranted, may prove to be wasteful of packaging material and does not facilitate ready access to individual articles so packaged.

Alternatively, a number of articles may have to be disposed in a single such container. When a number of articles are to be disposed in a single carton, package, box or similar container it has, at times, become practicable to subdivide the container to separate the articles disposed therein one from the other. This has generally been done to protect the articles from damage or breakage which might occur if the articles struck each other during container movement when the container is being transported or moved from one place to another. One common method of subdividing such a container is to insert within the container dividers of cardboard, or the like, and which extend from the bottom of the inside of the container to the top of the inside of the container. When such subdividers are respectively notched and interfitted with each other the resulting container dividing construction has been referred to as being "egg-crate" like. Such constructions are quite often utilized to separate bottles of liquor or the like or items of glassware one from the other to minimize breakage of the fragile items. But, because the container dividers such as these extend from the bottom to the top of the container removal of the articles from the container becomes burdensome and difficult unless the article necks down at its top such as found for liquor bottles and the like. Otherwise top to bottom subdivision may prove to be unsatisfactory and unacceptable.

Another form of construction of a single container for a plurality of articles is shown in U.S. Pat. No. 1,066,449 issued on July 1, 1913 to G. N. Johnson for *Miner's Emergency Case.* Such construction, however, encloses the entire length of the articles in a tube-like divider within the container and requires a spring to push the article out of the tube thus adding to the cost of containerization of the article. Such a container, furthermore, only provides for two articles and requires movement of the second article to the spring biased divided portion of the container for article dispensing.

In addition, only a portion of each article is dispensed at a time and that must be severed from the rest of the article. Thus, this configuration of article container will be unacceptable where an entire article must be readily and easily removed from an economical container holding a number of such articles.

Other constructions of subdivided containers for storing a number of articles, especially articles of elongated configuration, are shown: in U.S. Pat. No. 1,163,183 issued on Dec. 7, 1915 to D. Stoll for *Cigarette Box;* in U.S. Pat. No. 2,528,743 issued on Nov. 7, 1950 to E. T. Eggebrecht for *Cigarette Case;* and in U.S. Pat. No. 2,812,057 issued on Nov. 5, 1957 to C. F. Brownfield for *Unique Container or Package.* However, all of these constructions subdivide the article container from top to bottom and subdivide the complex and costly spring actuated or similar mechanisms to project the stored articles from the container top in order to obtain access to the stored articles. The cost of providing such a container construction may thus be economically unwarranted in view of the articles to be stored within and removed from the container. In addition, if the mechanisms provided to project the articles from such containers fails it may become difficult, if not impossible to obtain access to and to remove the articles from the container.

Still other container constructions for multiple articles are shown, for example, in U.S. Pat. No. 2,039,559 issued on May 5, 1936 to H. R. Segal for *Cigarette Case* and in U.S. Pat. No. 3,446,338 issued on May 27, 1969 to D. B. Bozyk for *Package.* While such container constructions are such as to facilitate access to each of the multiple articles disposed in the container they require the operation of mechanisms built into the containers to do so thus adding, maybe unduly, to the relative cost and operation of the container construction. In addition, the containers are not subdivided and so the individual articles disposed within the containers are not in any way separated from each other.

SUMMARY OF THE INVENTION

It therefore and object of this invention to provide new and improved article containers.

It is another object of this invention to provide new and improved containers for a plurality of articles.

It is yet another object of this invention to provide new and improved containers for a plurality of articles wherein the containers are subdivided to separate each article from each other article.

It is yet still another object of this invention to provide new and improved containers for a plurality of articles wherein the containers are subdivided to separate each article from each other article in such a way that the respective articles may be readily and easily removed, one by one, from the container.

It is yet still a further object of this invention to provide new and improved subdivided containers for a plurality of flares.

It is yet still a further object of this invention to provide new and improved subdivided containers for a plurality of flares such that the wires provided with the flares to facilitate use thereof do not interfere with removal of the flares from the containers.

Other objects, features and advantages of these inventions in their details of construction and arrangement of parts will be seen from the above, from the description of the preferred embodiment when considered with the drawing and from the appended claims.

BRIEF DESCRIPTION OF THE DRAWINGS

In the drawing:

FIG. 1 is a perspective of a subdivided container for flares incorporating the instant invention;

FIG. 2 is a perspective showing of the container subdividing structure for the container of FIG. 1, showing same reduced in size and exploded to better show detail thereof; and FIG. 3 is a perspective showing of an alternative embodiment of container subdividing structure incorporating the instant invention.

DESCRIPTION OF THE PREFERRED EMBODIMENTS

With reference to FIG. 1 there is generally shown at 10 a container for a plurality (multiplicity) of articles in the form of flares 12 of the type used on or near roadways to signal oncoming motorists of traffic or other roadway problems. Flares 12 are of conventional construction in that they are of an elongated, stick-like, solid cylindrical configuration having a body 14 with a top 16 and a base 18 disposed within a cap 20. Cap 20 may be of metallic or other suitable material of a size and configuration to hold flare 12 and includes at least a pair of wire supports 22 which serve to support and position flare 12, in a conventional manner, when flare 12 is in use. While flares 12 have been shown as being of cylindrical cross-sectional configuration it should be understood that such flares might just as well be of any other convenient and available cross-sectional configuration such as square, triangular, octagonal, or the like.

Container 10 is in the configuration of a carton, box or the like and forms a package for a plurality of flares 12. Container 10 includes a bottom 30, sides 32, 34, 36 and 38 extending up from bottom 30 and a top 40. A downwardly extending lip 42 is provided around top 40 and meets sides 32, 34, 36 and 38 along an upper edge 46.

Bottom 30, sides 32, 34, 36 and 38, top 40 and lip 42 of boxboard or other suitable material or materials and of a size and configuration depending upon and to receive a house a particular number of flares 12 of a particular size and configuration as described above. If desired, container 10 may have its bottom 30, sides 32, 34, 36 and 38, top 40 and its lip 42 conventionally molded from suitable plastic or like material or materials.

A subdividing structure 60 (FIGS. 1 and 2) is disposed at the bottom of container 10, and subdivides container 10 into a number of compartments 70 each of a size and configuration to receive, hold and permit ready and easy removal of a flare 10. Subdividing structure 60 is of an "egg crate divider" like construction and is constructed from an elongated divider member 80 having a length to span the space between sides 32, 36 within container 10, and a number of cross-dividers 82 each having a length to span the space between sides 34, 38 within container 10. A number of downwardly facing notches 84 are formed in divider 80 each of a size and configuration to be mated with an upwardly facing notch 86 formed in each cross-divider 80. When divider 80 and cross-dividers 82 have their respective notches 84, 86 mated the subdividing structure 60 shown in FIG. 1 is assembled. The number of notches 84 formed in divider 80 will correspond to the number of cross-dividers 82, and the number of cross-dividers 82 will depending upon how many compartments 70 are to be provided within container 10. If desired, additional rows of compartments may be provided for by utilizing additional dividers such as dividers 80, in which situation cross-dividers 82 will be provided with additional upwardly facing notches 86. Notches 86 may also be formed to face downwardly and be mated with upwardly facing notches 84 formed in divider 80. Divider members 80, 82 may be conventionally formed from cardboard, boxboard, plastic or other suitable material or materials. The entire subdividing structure 60 may also be conventionally molded as an assembled structure in one piece from suitable plastic or other moldable material.

The height "H" (FIGS. 1 and 2) of members 80, 82 and of the assembled subdividing structure 60, is selected so that ends 90 (FIG. 1) of wire supports 22 extend above subdividing structure 60 and are not trapped within a compartment 70.

The extent to which lip 42 (FIG. 1) of container 10 extends down from top 40 of container 10 (or alternatively the extent to which sides 32, 34, 36 and 38 extend up from bottom 30 of container 10) is selected so that when container 01 is opened, by pivoting top 40 out of the way or by removing top 40, the tops 16 of flares 12 will be disposed for easy grasping by a person desiring to obtain a flare 12.

Subdividing structure 60 may either be placed at the bottom of container 10 or it may be secured within container 10 by suitable adhesive or attaching means (not shown).

An alternative embodiment of subdividing structure for container 10 is shown at 100 in FIG. 3. Structure 100 is conventionally constructed from high density foam or other suitable plastic and includes a body 102 having a plurality of pockets or compartments 104 each of a size and configuration to receive a flare 12 for suitable disposition therewithin and ready and relatively easy removal therefrom. As shown in FIG. 3, there are two rows of compartments 104 but more or less rows of more or less compartments 104 may be provided.

Subdividing structure 100 is placed within container 10 and secured in place on top of bottom 30 thereof in place of subdividing structure 60 (FIG. 1). The height "H" (FIG. 3) of subdividing structure 100 is selected so that ends 90 (FIG. 1) of wire supports 22 of flares 12, when disposed within compartments 104, will be disposed above the height of a top 106 of subdividing structure 100. When subdividing structure 100 is disposed in a container, such as container 10, and flares 12 are disposed in compartments 104 as explained above, top 14 of flares 12 will be disposed above lip 46 of container 10 so that flares 12 may be readily and easily removed from compartments 104 of subdividing structure 100 and thus from container 10.

From the above description it will thus be seen that there has been provided novel and improved subdivided containers for road flares that facilitate the disposition of flares within the container while also facilitating ready removal of the flares from the container.

It is understood that although there has been shown preferred embodiments of this invention, that various modifications may be made in the details thereof without departing from the spirit as comprehended by the following claims.

What is claimed is:

1. A container for receiving a plurality of articles such as road flares, or the like, wherein each article is of generally elongated stick-like configuration and includes a wire support structure having ends disposed at a predetermined position between respective ends of the article; comprising:

(a) container body means including at least a bottom and a plurality of sides extending up from said bottom to define therebetween an enclosed container space having a bottom and sides rising up from said bottom to a first predetermined height;

(b) article support structure means disposed within said container space proximate said bottom and of a configuration and construction to provide a plurality of article components extending up from said container bottom, open at their respective tops, with each such compartment of a size and configuration to receive and support a road flare so that the flare wire support structure ends are disposed above said article support structure means.

2. The container of claim 1, wherein said article support structure means is of a second predetermined height which is shorter in size than said first predetermined height of said container sides.

3. The container of claim 1, wherein said container body means also includes a container top of a size, configuration and construction to cover said container space, the tops of the road flares extending above said first predetermined height of said container walls, and said container top when disposed in cooperation with said container fully closes said container space including the tops of the road flares.

4. The container of claim 3, wherein said article support structure includes at least a first support structure member and at least a pair of cross-support members each of which coact with said first support structure member to form an "egg crate" like construction and wherein said support member and said cross-support members include respective surfaces which are disposed in spaced relationship to each other to define said article components.

5. The container of claim 4, wherein said support member includes at least two spaced notches extending in from an edge of said support member and of a size and configuration to receive within each such notch a cross-support member and wherein said cross-support members each include at least one notch extending in from an edge of each such cross-support member and of a size and configuration to receive within each such notch said support member to form said "egg crate" like construction.

6. The container of claim 5, wherein said article support structure includes a plurality of said support members and a plurality of said cross-support members which coact together to form said article support structure.

7. The container of claim 5, wherein said container body bottom and sides coact to form a substantially cubical article enclosure and said article support structure is disposed proximate said bottom of said substantially cubical article enclosure and substantially fills same.

8. The container of claim 7, wherein there are at least two rows of article components, each row including a plurality of article compartments.

9. The container of claim 3, wherein said article support structure is constructed from a block of foam and said article compartments are formed therein.

10. The container of claim 3, wherein said container body bottom and sides coact to form a substantially cubical article enclosure and said article support structure is disposed proximate said bottom of said substantially cubical article enclosure and substantially fills same.

11. The container of claim 10, wherein there are two rows of article compartments each row including a plurality of article components.

12. The container of claim 11, wherein the road flares are of substantially cylindrical configuration with a substantially circular cross-section and said article support compartments are of substantially cylindrical hollow configuration and of a size and configuration to receive the road flares and support same within the container.

13. The container of claim 1, wherein the road flares are of substantially cylindrical configuration with a substantially circular cross-section and said article support compartments are of a size and configuration to receive the road flares and support same within the container.

14. The container of claim 13, wherein said article compartments are open top rectangles.

15. The container of claim 14, wherein said article compartments are open top squares.

* * * * *